US007927264B2

(12) United States Patent
Verheem

(10) Patent No.: US 7,927,264 B2
(45) Date of Patent: Apr. 19, 2011

(54) LOW-IMPACT INERTIAL EXERCISE DEVICE

(75) Inventor: Johann B. Verheem, Carlsbad, CA (US)

(73) Assignee: Fitness IQ LLC, Vista, CA (US)

( * ) Notice: Subject to any disclaimer, the term of this patent is extended or adjusted under 35 U.S.C. 154(b) by 59 days.

(21) Appl. No.: 12/508,921

(22) Filed: Jul. 24, 2009

(65) Prior Publication Data

US 2011/0021328 A1 Jan. 27, 2011

(51) Int. Cl.
*A63B 21/00* (2006.01)

(52) U.S. Cl. ..... 482/110; 482/127; 482/126; 482/104

(58) Field of Classification Search ..... 482/110, 482/127, 126, 82, 121, 104–108
See application file for complete search history.

(56) References Cited

U.S. PATENT DOCUMENTS

| | | | | |
|---|---|---|---|---|
| 818,242 | A | 12/1905 | Geisel | |
| 2,528,213 | A | 10/1950 | Dantolan | |
| 3,006,646 | A | 10/1961 | Nanni | |
| 3,544,106 | A | 12/1970 | Barrett | |
| 3,545,121 | A | 12/1970 | Misko | |
| 3,761,083 | A | 9/1973 | Buchner | |
| 4,154,018 | A | 5/1979 | Churchman | |
| 4,623,146 | A | 11/1986 | Jackson | |
| 4,775,149 | A | 10/1988 | Wilson | |
| 4,978,122 | A | 12/1990 | Dibowski | |
| 5,046,727 | A | 9/1991 | Wilkinson et al. | |
| 5,152,731 | A * | 10/1992 | Troutman | 482/106 |
| 5,312,308 | A | 5/1994 | Hamilton | |
| 5,334,118 | A | 8/1994 | Dantolan | |
| 5,474,511 | A | 12/1995 | Dantolan | |
| 5,643,158 | A * | 7/1997 | Clementi | 482/121 |
| 5,823,922 | A | 10/1998 | Eckmann | |
| 5,871,423 | A * | 2/1999 | Pruchnik | 482/110 |
| 5,967,953 | A * | 10/1999 | Nunez | 482/121 |
| 6,099,442 | A | 8/2000 | Krull | |
| 6,099,444 | A | 8/2000 | Domenge | |
| 6,179,758 | B1 | 1/2001 | Domenge | |
| 6,193,637 | B1 | 2/2001 | Corbin | |
| 6,500,102 | B1 | 12/2002 | Domenge | |
| 6,746,373 | B1 | 6/2004 | Bohmer | |
| 6,945,918 | B1 | 9/2005 | Hill | |
| 7,001,310 | B1 | 2/2006 | Brice | |
| 7,048,678 | B2 | 5/2006 | Harms et al. | |
| 7,175,575 | B1 * | 2/2007 | Dantolen | 482/128 |
| 7,314,438 | B1 | 1/2008 | Clark et al. | |

(Continued)

FOREIGN PATENT DOCUMENTS

| | | |
|---|---|---|
| CN | 02232093.2 | 11/2003 |

(Continued)

*Primary Examiner* — Jerome W Donnelly
(74) *Attorney, Agent, or Firm* — The Nath Law Group; Laurie A. Axford

(57) ABSTRACT

In one aspect of the disclosed embodiments, an inertial exercise device has an elongate member with opposing first and second end portions, and a sleeve movably coupled to the elongate member and disposed between the first and second end portions of the elongate member. A first elastic resistance element interfaces between the elongate member and the sleeve. A user-induced rhythmic movement of the sleeve along the elongate member alternatively toward the opposing first and second end portions causes the first elastic resistance element to alternately compress and extend as the first and second end portions of the elongate member oscillate relative to the sleeve.

8 Claims, 12 Drawing Sheets

U.S. PATENT DOCUMENTS

| | | | |
|---|---|---|---|
| 7,497,814 | B1 | 3/2009 | Krull |
| 7,520,844 | B1 | 4/2009 | Flynn |
| 7,614,983 | B1 | 11/2009 | Krull |
| 7,621,855 | B1 | 11/2009 | Krull |
| D610,636 | S | 2/2010 | Golesh et al. |
| 2004/0087419 | A1 | 5/2004 | Ware et al. |
| 2006/0223682 | A1 | 10/2006 | Joe |

FOREIGN PATENT DOCUMENTS

| | | | |
|---|---|---|---|
| CN | 200620045130.8 | | 5/2008 |
| CN | 201342210 | Y | 11/2009 |
| GB | 1362798 | | 8/1994 |
| JP | 9192262 | | 7/1997 |
| RU | 2027456 | C1 | 1/1995 |
| RU | 2060042 | C1 | 5/1996 |
| TW | 552955 | | 9/2003 |
| TW | 552955 | Y | 11/2003 |
| TW | M355720 | U1 | 5/2009 |
| TW | M376318 | U1 | 3/2010 |

* cited by examiner

LOW-IMPACT INERTIAL EXERCISE DEVICE

FIELD

The following description relates generally to exercise equipment, and more particularly to an inertial exercise device that can be used to tone the upper body.

BACKGROUND

In-home personal exercise and weight loss equipment is an increasingly popular field. Due to the expense of health club memberships and the time required to travel to health clubs, many people desire to exercise at home. However, many exercise machines are very expensive and require a dedicated area or room for use and/or storage. For these reasons many people do not wish to own a large exercise machine that can exercise several different muscles.

Alternatives to large home fitness machines include free weights such as dumbbells. Dumbbells have the advantage of being relatively inexpensive and easy to use. However, one drawback of dumbbells is that they are often very heavy and therefore can cause injury if a user excessively strains herself or uses poor technique. Additionally, although there are many different dumbbell exercises, each requires a slightly different technique. Many users will not be aware of all the different possible exercise, much less the proper technique for each exercise. Accordingly, many users end up doing the same simple exercises over and over again. This results in some muscles being exercised excessively, with other muscles being ignored completely.

Accordingly, there are needs for a home fitness device that is simple and safe to use, that is relatively inexpensive, that does not require a dedicated area for use or storage, and that effectively exercises several different muscles. The embodiments of a low-impact inertial exercise device disclosed below satisfy these needs.

SUMMARY

The following simplified summary is provided in order to provide a basic understanding of some aspects of the claimed subject matter. This summary is not an extensive overview, and is not intended to identify key/critical elements or to delineate the scope of the claimed subject matter. Its purpose is to present some concepts in a simplified form as a prelude to the more detailed description that is presented later.

In one aspect of the disclosed embodiments, an inertial exercise device has an elongate member with opposing first and second end portions, and a sleeve movably coupled to the elongate member and disposed between the first and second end portions of the elongate member. A first elastic resistance element interfaces between the elongate member and the sleeve. A user-induced rhythmic movement of the sleeve along the elongate member alternatively toward the opposing first and second end portions causes the first elastic resistance element to alternately compress and extend as the first and second end portions of the elongate member oscillate relative to the sleeve.

The first elastic resistance element may be mounted on the elongate member itself. The sleeve may have a first internal shoulder such that the first elastic resistance element is disposed between the first internal shoulder of the sleeve and the first end portion of the elongate member. The first internal shoulder of the sleeve may a slide bearing or formed as part of an internal bore of the sleeve. The first elastic resistance element may be a spring, for example a helical spring mounted coaxially with the elongate member and the sleeve.

The sleeve may further include a second internal shoulder opposite the first internal shoulder, and the exercise device may also include a second elastic resistance element mounted on the elongate member and disposed between the second internal shoulder and the second end portion of the elongate member. If so, the second elastic resistance element compresses when the first elastic resistance element extends, and extends when the first elastic resistance element compresses.

The exercise device may have a first weight attached to the first end portion of the elongate member and a second weight attached to the second end portion of the elongate member. A flexible boot may be attached to the sleeve and the first weight, the flexible boot enveloping the first elastic resistance element. The flexible boot, the first weight, and the sleeve may together form an air bellows that expels air through an aperture in the air bellows as the first elastic resistance element compresses in response to the user-induced rhythmic movement of the sleeve along the elongate member. The exercise device may also have a second flexible boot attached to the sleeve and the second weight, the second flexible boot enveloping the second elastic resistance element. A central portion of the elongate member may have an external shoulder such that the first elastic resistance member is disposed between the external shoulder of the elongate member and the first internal shoulder of the sleeve.

In another aspect of the disclosed embodiments, an inertial exercise device has first and second terminal masses rigidly linked together by a central shaft, the first and second terminal masses and the central shaft collectively having an inertia. An actuating sleeve is slidably mounted around the central shaft and has an internal bore with a first peripheral shoulder. A first elastic resistance element is mounted on the central shaft within the internal bore of the actuating sleeve and is disposed between the first terminal mass and the first peripheral shoulder. The first and second terminal masses and the central shaft are slidable relative to the actuating sleeve between a first position with the first elastic resistance element compressed between the first terminal mass and the first peripheral shoulder and a second position with the first elastic resistance element extended. The inertia of the first and second terminal masses and the central shaft causes the actuating sleeve to oscillate relative to the first and second terminal masses and the central shaft in response to alternating rhythmic linear motion imparted to the actuating sleeve by a user of the inertial exercise device.

The internal bore of the actuating sleeve further may also have a second peripheral shoulder, and the inertial exercise device may also have a second elastic resistance element mounted on the central shaft within the internal bore of the actuating sleeve and disposed between the second terminal mass and the second peripheral shoulder. If so, the second elastic resistance element is extended when the first and second terminal masses and the central shaft are in the first position, and the second elastic resistance element is compressed between the second terminal mass and the second peripheral shoulder when the first and second terminal masses and the central shaft are in the second position.

The first and second terminal masses may be disposed within the internal bore of the actuating sleeve, and the first and second peripheral shoulders of the actuating sleeve may be opposing faces of a ridge in the internal bore of the actuating sleeve.

In yet another aspect of the present embodiments, an inertial exercise device has an actuating cylinder with opposing first and second ends and an internal bore. At least one mass is slidably mounted in the internal bore of the actuating cylinder. First and second elastic resistance elements are mounted within the internal bore of the actuating cylinder and resist motion of the at least one mass toward the ends of the actuating cylinder. The at least one mass is slidable relative to the actuating cylinder between a first position with the first elastic resistance element compressed and a second position with the first elastic resistance element extended. The inertia of the at least one mass causes the at least one mass to oscillate relative to the actuating cylinder in response to alternating rhythmic linear motion imparted to the actuating cylinder by a user of the inertial exercise device.

The inertial exercise device may also have a second mass rigidly connected to the at least one mass by a central shaft. The internal bore of the actuating cylinder may include first and second peripheral shoulders. If so, the first elastic resistance element is disposed between the first peripheral shoulder and the at least one mass, and the second elastic resistance element is disposed between the second peripheral shoulder and the second mass. The at least one mass may have first and second opposing faces such that the first elastic resistance element is disposed between the first face of the at least one mass and the first end of the actuating cylinder, and the second elastic resistance element is disposed between the second face of the at least one mass and the second end of the actuating cylinder.

To the accomplishment of the foregoing and related ends, certain illustrative aspects are described herein in connection with the following description and the annexed drawings. These aspects are indicative, however, of but a few of the various ways in which the principles of the claimed subject matter may be employed and the claimed subject matter is intended to include all such aspects and their equivalents. Other advantages and novel features may become apparent from the following detailed description when considered in conjunction with the drawings.

DETAILED DESCRIPTION

In one aspect of the disclosed embodiments, an inertial exercise device has an elongate member with opposing first and second end portions, and a sleeve movably coupled to the elongate member and disposed between the first and second end portions of the elongate member. A first elastic resistance element interfaces between the elongate member and the sleeve. A user-induced rhythmic movement of the sleeve along the elongate member alternatively toward the opposing first and second end portions causes the first elastic resistance element to alternately compress and extend as the first and second end portions of the elongate member oscillate relative to the sleeve.

Figure 1:
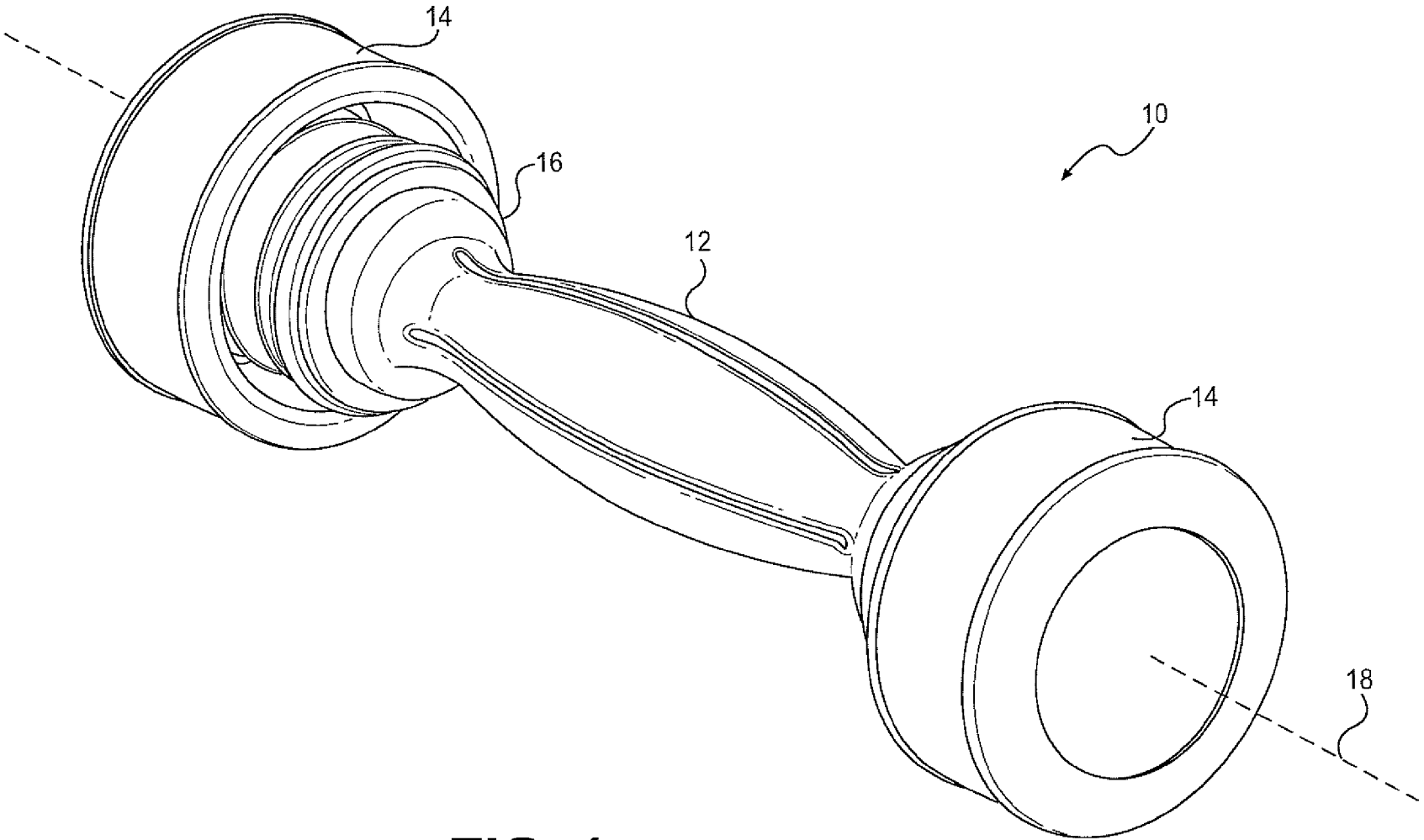
FIG. 1 is a perspective view of one embodiment of an inertial exercise device.

FIG. 1 is an illustration of a perspective view of one embodiment of an inertial exercise device 10. In this embodiment, exercise device 10 is in the general shape of a dumbbell, having a center actuating sleeve 12 and opposing terminal masses 14 that are movably coupled to actuating sleeve 12. Flexible boots 16 extend between actuating sleeve 12 and terminal masses 14, and serve to conceal internal elements (discussed below) that functionally couple actuating sleeve 12 to terminal masses 14. Actuating sleeve 12 is provided to enable a user to grip or otherwise hold inertial exercise device 10 with one or both hands, or with another body part. The actual shape or contour of the actuating sleeve 12, terminal masses 14, and flexible boots 16 may be changed according to design preference. Therefore, modifications or alterations to the shape and appearance of inertial exercise device 10 may be made without departing from the spirit and scope of this invention. For example, the gripping portion 12 may be slimmer in size or contoured, or oriented transverse to longitudinal axis 18 of inertial exercise device 10. Similarly, inertial exercise device 10 is not necessarily shaped like a dumbbell and may, for example, be a straight cylindrical shaft.

Figure 2:
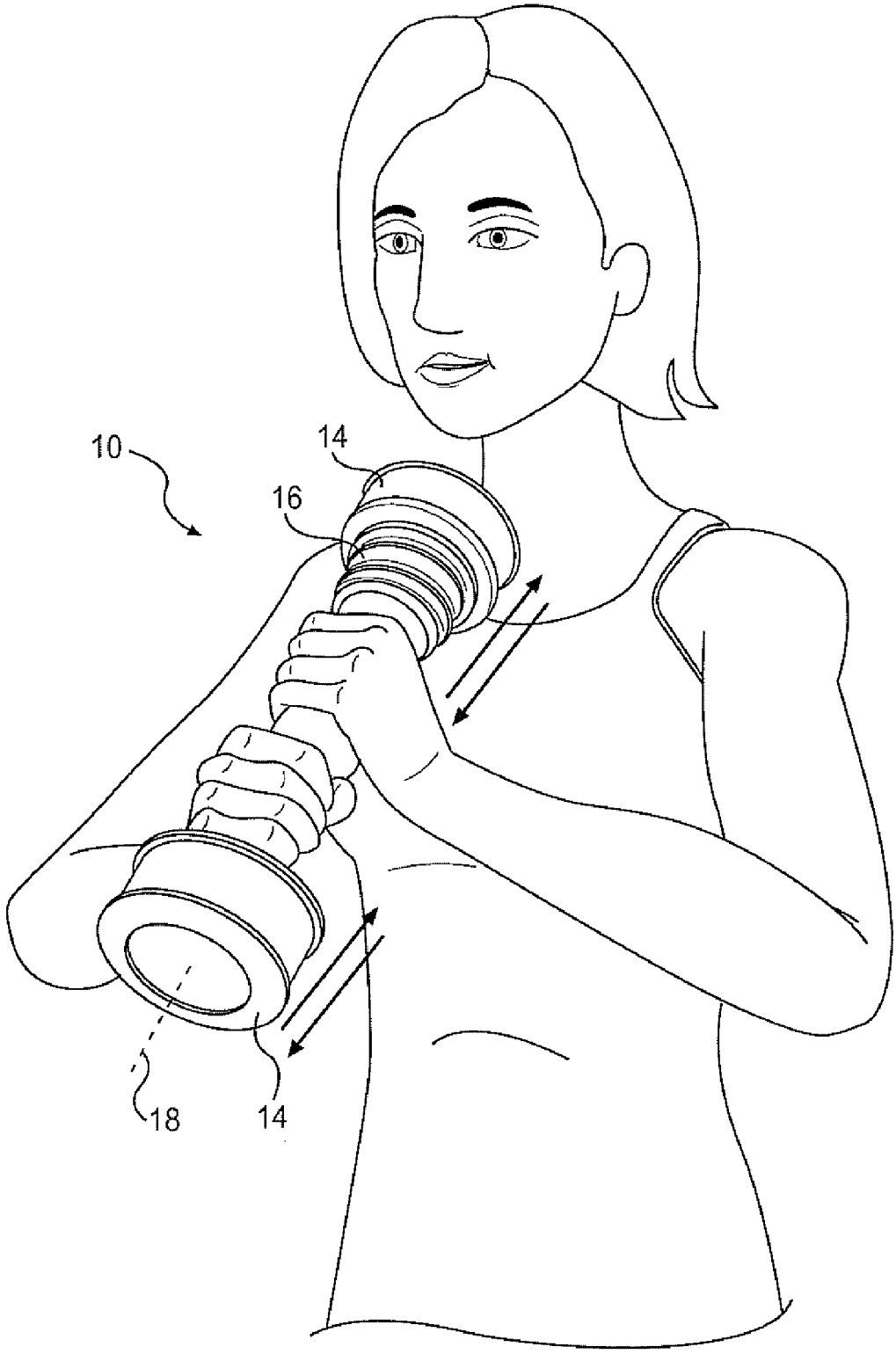
FIG. 2 is an illustration of the inertial exercise device of FIG. 1. in use.

Inertial exercise device 10 is devised to provide limited independent motion of actuating sleeve 12 relative to terminal masses 14. That is, in operation, the user grips or holds actuating sleeve 12 and "shakes" inertial exercise device 10, primarily along longitudinal axis 18, as shown in FIG. 2. Since terminal masses 14 are not rigidly fixed to actuating sleeve 12, but instead are movable relative thereto, terminal masses 14 will move out of time sync with the motion of actuating sleeve 12. In other words, due to the inertia of terminal masses 14, they will initially tend to remain at rest after the user rapidly moves actuating sleeve 12 in one direction along longitudinal axis 18. Eventually, terminal masses 14 move in the same direction as the initial movement of actuating sleeve 12, but the user then rapidly moves actuating sleeve 12 in the opposite direction along longitudinal axis 18. Due to the inertia of terminal masses 14, they will tend to remain in motion in the initial direction even after the user has rapidly moved actuating sleeve 12 in the opposite direction. Eventually, terminal masses 14 respond to the second movement of actuating sleeve 12 and begin to move in the opposite direction. Thus, the user must overcome the inertia of terminal masses 14 in order to rhythmically move or oscillate actuating sleeve 12 along longitudinal axis 18. This constant battle against the inertia of terminal masses 14 allows the user to vigorously exercise the muscles used to move actuating sleeve 12, even if the mass of terminal masses 14 is much smaller than in a traditional dumbbell.

Figure 3:
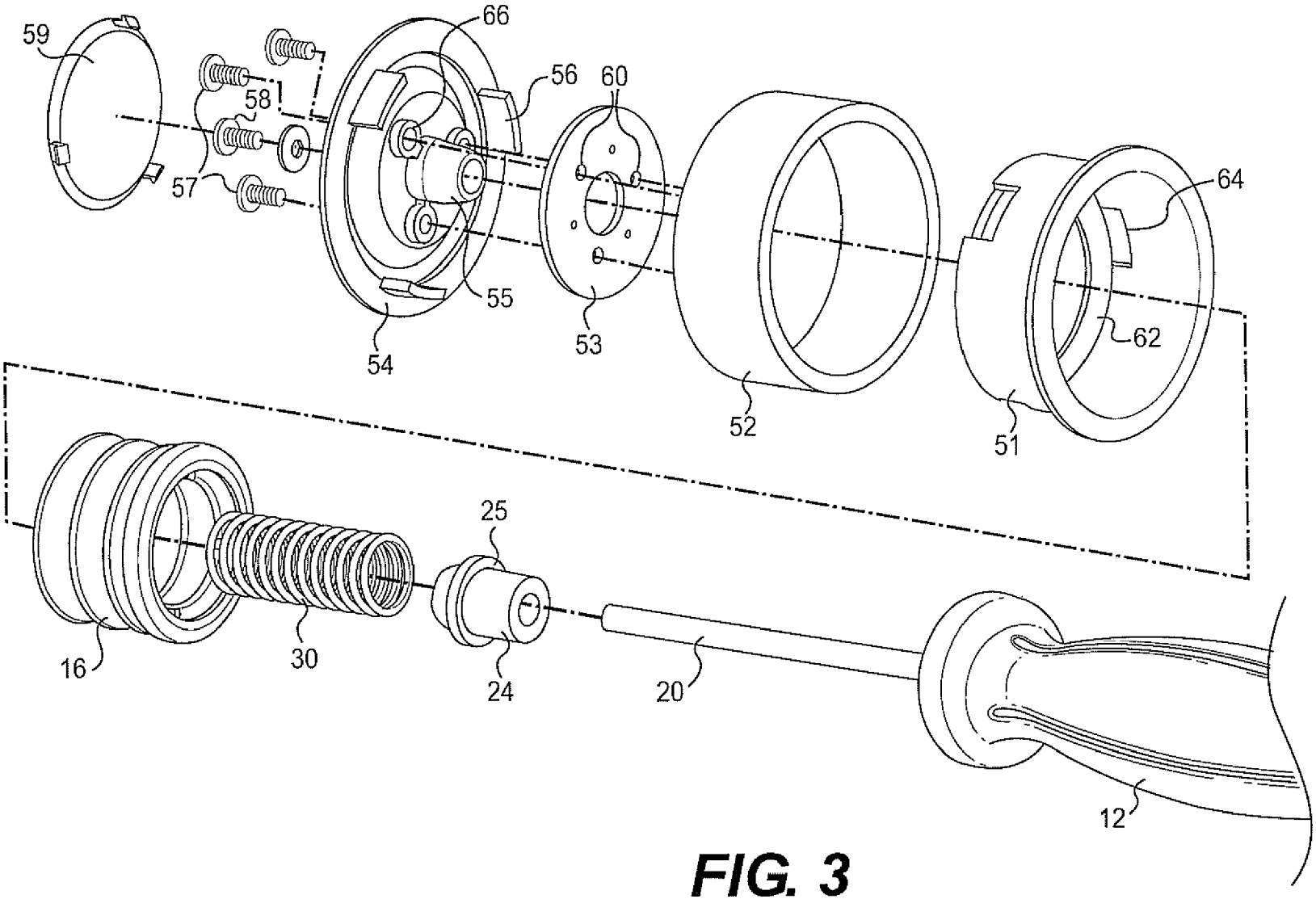
FIG. 3 is an exploded view of the inertial exercise device of FIG. 1.

FIG. 3 shows an exploded view of one end of inertial exercise device 10. Inertial exercise device 10 is preferably generally symmetrical so that the other end (not shown) of inertial exercise device 10 is of substantially the same construction. Actuating sleeve 12 is slidably or telescopically mounted on an elongate member such as central shaft 20. Thus, actuating sleeve 12 is free to slide back and forth along central shaft 20. To support sliding motion of actuating sleeve 12 along central shaft 20, slide bearing 24 is press fit into the internal bore of actuating sleeve 12. Thus, in this embodiment, the internal bore of actuating sleeve 12 does not directly contact central shaft 20, but instead is slidably supported thereon by slide bearing 24. Slide bearing 24 includes a peripheral flange or shoulder 25 which provides support for one end of elastic resistance element 30, which in this embodiment is a helical spring coaxially mounted on central shaft 20.

Terminal mass 14 is rigidly attached to central shaft 20 so that terminal mass 14 cannot move relative to central shaft 20. The bulk of terminal mass 14 is provided by annular inertial mass 52 which is sandwiched between inner cap 51 and outer cap 54. Outer cap 54 includes tubular protrusion 55 which receives central shaft 20. Outer cap 54 also includes one or more tabs 56 which engage with openings 64 in inner cap 51 when terminal mass 14 is assembled. Finally, outer cap 54 has one or more openings 66 for receiving fasteners 57.

Support disc 53 is mounted over tubular protrusion 55 and includes one or more threaded apertures 60. Support disc 53 serves at least two purposes. First, it provides a Support surface for the outer end of elastic resistance element 30 so that elastic resistance element 30 may be compressed between slide bearing 24 and support disc 53. Second, support disc 53 is used to clamp the various components of terminal mass 14 together. Support disc 53 is disposed upon peripheral flange 62 of inner cap 51 so that when fasteners 57 are inserted through openings 66 of outer cap 54 and into threaded apertures 60 of support disc 53, support disc 53 clamps inner cap 51 to outer cap 54 with inertial mass 52 between them.

Fastener 58 passes through tubular protrusion 55 in outer cap 54 and engages with an opening in the end of central shaft 20, thereby rigidly securing terminal mass 14 to central shaft 20. Finally, end cap 59 is press-fit onto outer cap 54 in order to conceal fasteners 57. As the outer surface of inertial mass 52 may be approximately flush with the peripheral edges of inner cap 51 and outer cap 54, and end cap 59 may be approximately flush with the outer surface of outer cap 54, terminal mass 14 can be provided with a smooth and sleek external appearance.

Also adding to the aesthetic appeal of inertial exercise device 10 are flexible boots 16 extending between each terminal mass 14 and the respective end of actuating sleeve 12. Each terminal mass 14, flexible boot 16 and end of actuating sleeve 12 together collectively form an air bellows. As actuating sleeve 12 travels toward terminal mass 14, air enclosed by flexible boot 16 is expelled out of one or more apertures. This aperture may be in flexible boot 16 or in a portion of terminal mass 14. The air bellows thus formed serves both to make a distinctive sound of air rushing in and out of the aperture as actuating sleeve 12 oscillates relative to central shaft 20, and also to partially cushion each collision between the ends of actuating sleeve 12 and each terminal mass 14. In other words, the air bellows prevents the ends of actuating sleeve 12 from "banging" into terminal masses 14 and making a harsh and potentially obnoxious sound, and instead softens the collisions and makes a "puffing" or "hissing" sound. Both the external appearance of flexible boots 16 and the rushing air sound enabled by inclusion of flexible boots 16 are aesthetically pleasing features of inertial exercise device 10. Additionally, by cushioning each collision between actuating sleeve 12 and terminal masses 14, wear and tear on inertial exercise device 10 is decreased.

Figure 4:
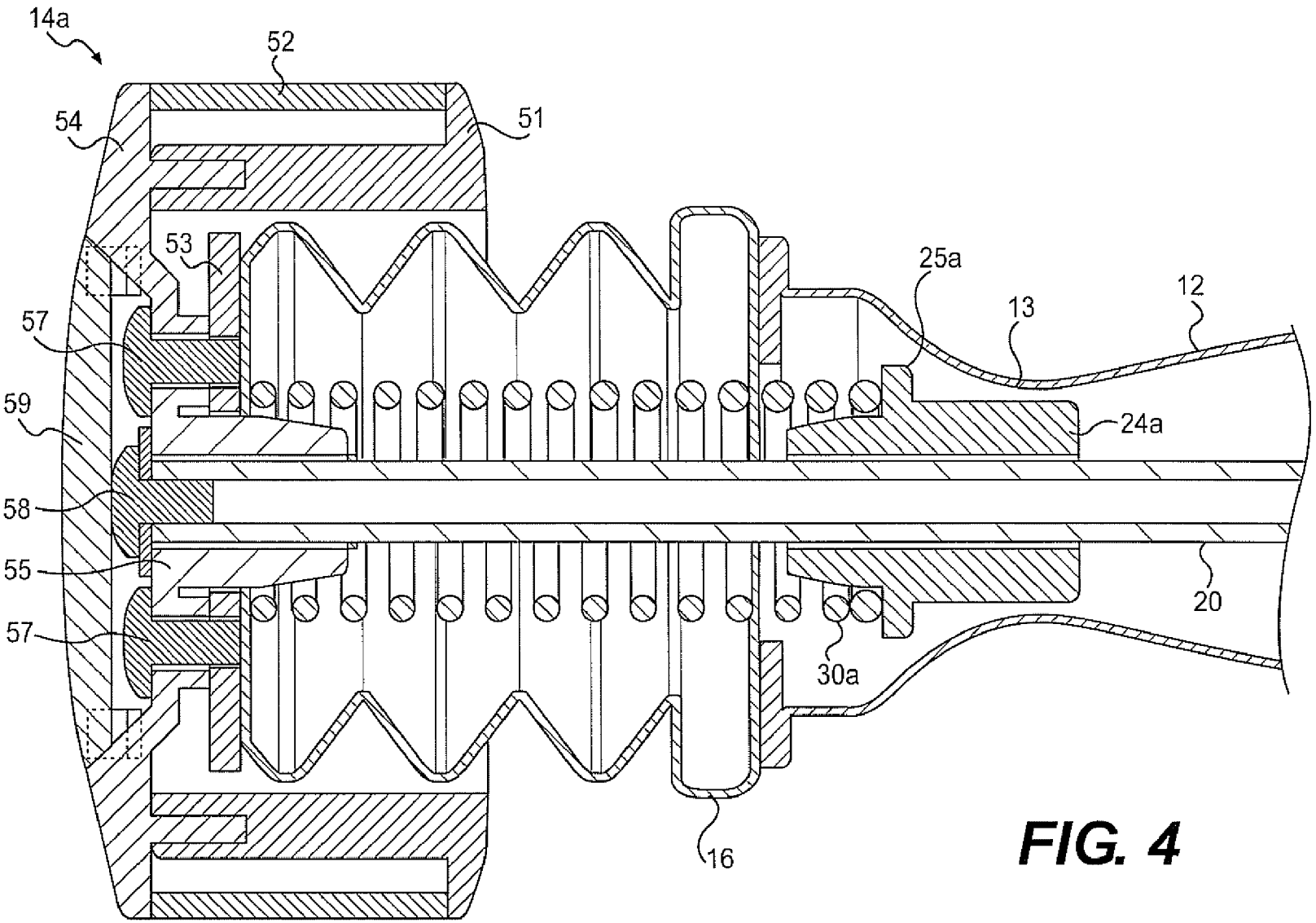
FIG. 4 is a cross-sectional view of one end of the inertial exercise device of FIG. 1 with the actuating sleeve spaced apart from a terminal mass.
Figure 5:
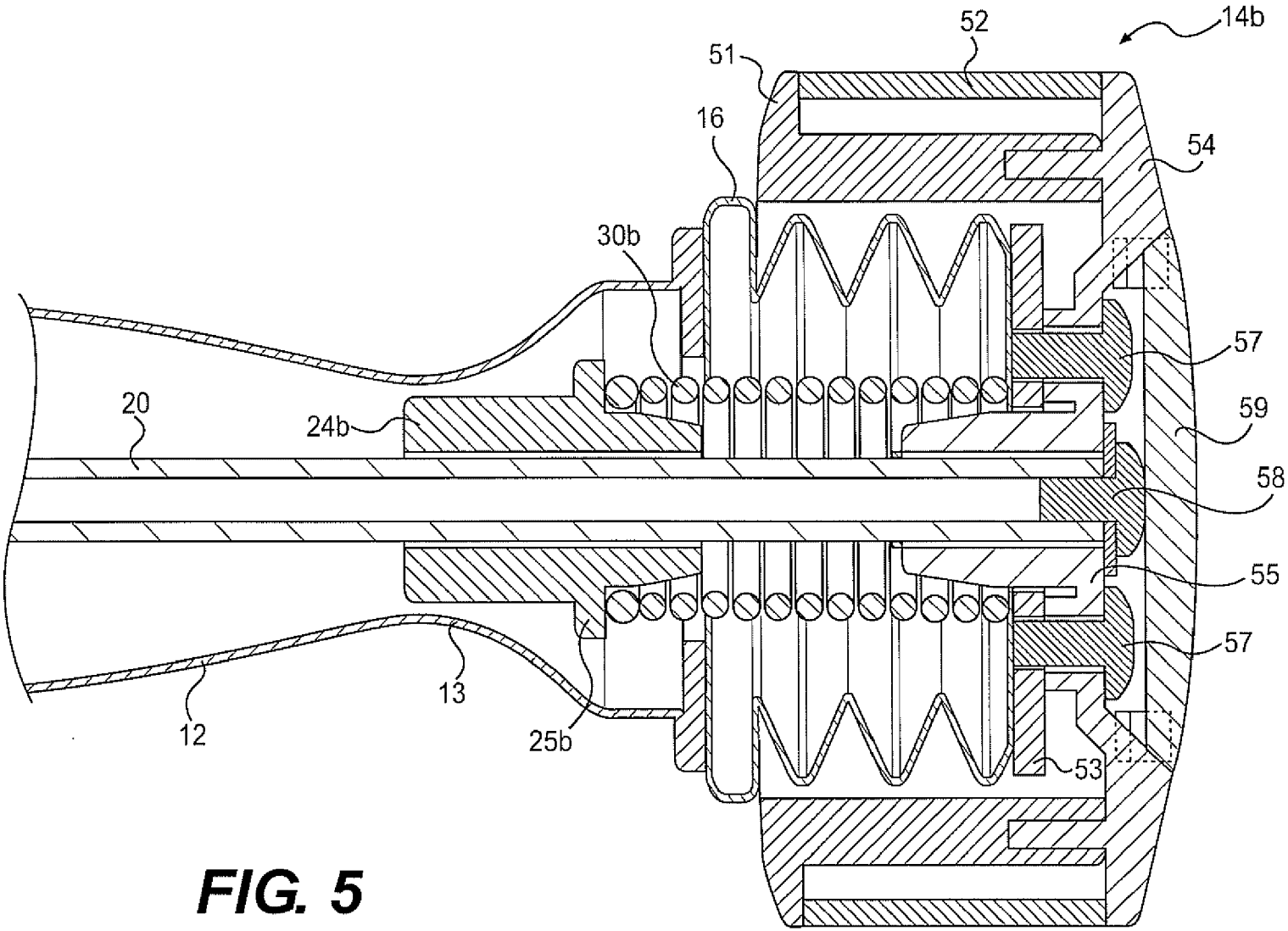
FIG. 5 is a cross-sectional view of one end of the inertial exercise device of FIG. 1 with the actuating sleeve adjacent to a terminal mass.

As shown in FIGS. 4 and 5, actuating sleeve 12 of inertial exercise device 10 is movable between two terminal positions. In the first terminal position, which is shown in FIGS. 4 and 5, actuating sleeve 12 is at its maximum distance from first terminal mass 14*a* and first elastic resistance element 30*a*, is extended. In this first terminal position, actuating sleeve 12 is also at its smallest distance from second terminal mass 14*b*, and second elastic resistance element 30*b*, is fully compressed between second slide bearing 24*b*, and second support disc 53*b*.

In the second terminal position, actuating sleeve 12 is at its smallest distance from first terminal mass 14*a*, and first elastic resistance element 30*a*, is fully compressed between first slide bearing 24*a*, and first support disc 53*a*. At the same time, actuating sleeve 12 is at its maximum distance from second terminal mass 14*b*, and second elastic resistance element 30*b*, is extended. Thus, the first and second terminal positions of actuating sleeve 12 are simply inverses of one another: when actuating sleeve 12 is closest to first terminal mass 14*a* (i.e. the second terminal position), first elastic resistance element 30*a*, is compressed and second elastic resistance element 30*b*, is extended, and when actuating sleeve 12 is closest to second terminal mass 14*b*, (i.e. the first terminal position), second elastic resistance element 30*b*, is compressed and first elastic resistance element 30*a*, is extended. Actuating sleeve 12 is slidable along central shaft 20 between these first and second terminal positions.

Although elastic resistance element 30 is shown to be compressed between slide bearing 24 and support disc 53, numerous alternative designs are available. For example, slide bearing 24 may be completely eliminated so that elastic resistance element 30 is supported by a shoulder 13 in actuating sleeve 12. This shoulder 13 is a region of the inner bore of actuating sleeve 12 of smaller diameter than elastic resistance element 30 so that elastic resistance element 30 contacts shoulder 13 and thereby resists movement of actuating sleeve 12 toward terminal mass 14. Alternatively, slide bearing 24 may be integrally formed with actuating sleeve 12. Additionally, support disc 53 may be eliminated so that elastic resistance element 30 is compressed against outer cap 54. Alternatively, support disc 53 may be replaced by a flange integrally formed or otherwise attached to the end of central shaft 20.

Figure 6:
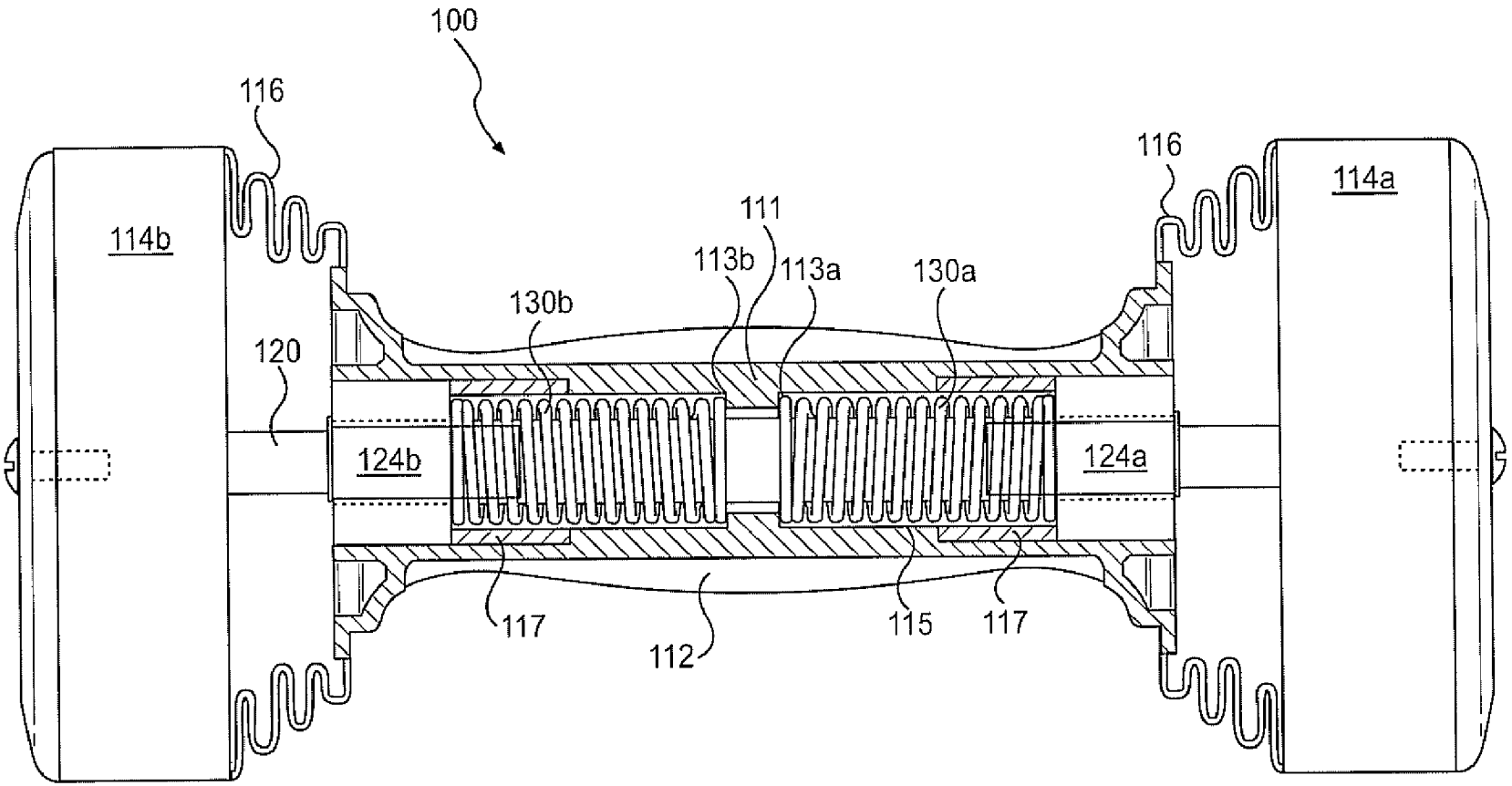
FIG. 6 is a cutaway view of an alternative embodiment of an inertial exercise device.
Figure 7:
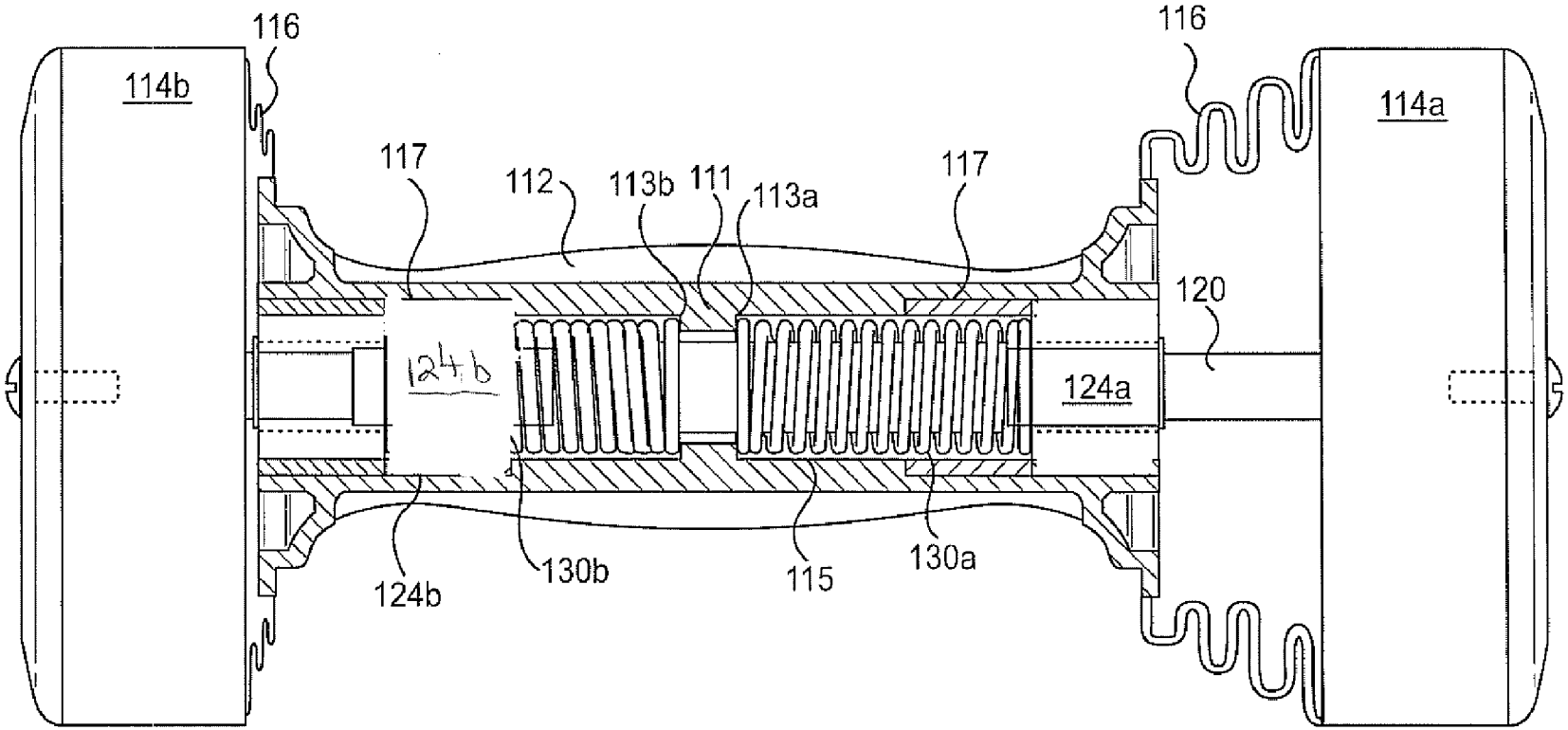
FIG. 7 is a cross-sectional view of the inertial exercise device of FIG. 6 with the actuating sleeve adjacent to a terminal mass.

Another embodiment of an inertial exercise device is shown in FIGS. 6 and 7. In this embodiment, inertial exercise device 100 includes actuating sleeve 112 which is slidably mounted on central shaft 120. Terminal masses 114*a*, and 114*b*, are rigidly secured to the ends of central shaft 120 so that actuating sleeve 112 is movable relative to central shaft 120 and terminal masses 114*a*, and 114*b*. Elastic resistance elements 130*a*, and 130*b*, are mounted on central shaft 120 inside internal bore 115 of actuating sleeve 112. Internal bore 115 of actuating sleeve 112 includes first and second peripheral shoulders 113 which contact the ends of elastic resistance elements 130. First and second peripheral shoulders 113 may be the opposing surfaces of one ridge 111 formed on internal bore 115, but may also be the surfaces of two separate ridges or protrusions formed on internal bore 115. In FIG. 6, actuating sleeve 112 is shown in its neutral position, centered between terminal masses 114*a*, and 114*b*.

Slide bearings 124*a*, and 124*b*, are mounted on central shaft 120 and support sliding or telescoping movement of actuating sleeve 112 along central shaft 120. Slide bearings 124*a*, and 124*b*, are fixedly secured to central shaft 120 so that actuating sleeve 112 moves relative to slide bearings 124*a*, and 124*b*, when inertial exercise device 100 is used by the user. Actuating sleeve 112 therefore includes chambers 117 at both ends of inner bore 115 in order to accommodate slide bearings 124*a*, and 124*b*, as actuating sleeve 112 slides back and forth along central shaft 120. Thus, as actuating sleeve 112 is slid by the user away from terminal mass 114*a*, and toward terminal mass 114*b*,, second elastic resistance element 130*b*, is compressed between second peripheral shoulder 113*b*, and second slide bearing 124*b*, thereby resisting the motion of actuating sleeve 112. When actuating sleeve 112 reaches the end of its travel toward terminal mass 114*b*,, as shown in FIG. 7, it can be seen that slide bearing 124*b*, is then at the inner end of chamber 117. Similarly, when the user reverses the motion of actuating sleeve 112 so that it slides toward terminal mass 114*a*,, first elastic resistance element 130*a*, is compressed between first peripheral shoulder 113*a*, and first slide bearing 124*a*,, thereby resisting such motion of actuating sleeve 112.

Inertial exercise device 100 optionally includes flexible boots 116 extending between terminal masses 114*a*, and 114*b*, and each respective end of actuating sleeve 112. Each terminal mass 114*a*, and 114*b*,, flexible boot 116 and end of actuating sleeve 112 together collectively form an air bellows. The functions and features of this air bellows are analogous to the air bellows discussed above in reference to the previously disclosed embodiment. As actuating sleeve 112 oscillates relative to central shaft 120 and terminal masses 114*a*, and 114*b*,, air enclosed by flexible boot 116 is expelled in and out of an aperture in the air bellows. The air bellows thus formed serves both to make a distinctive sound of air rushing out of the aperture and to partially cushion each collision between the ends of actuating sleeve 112 and terminal mass 114.

Figure 8:
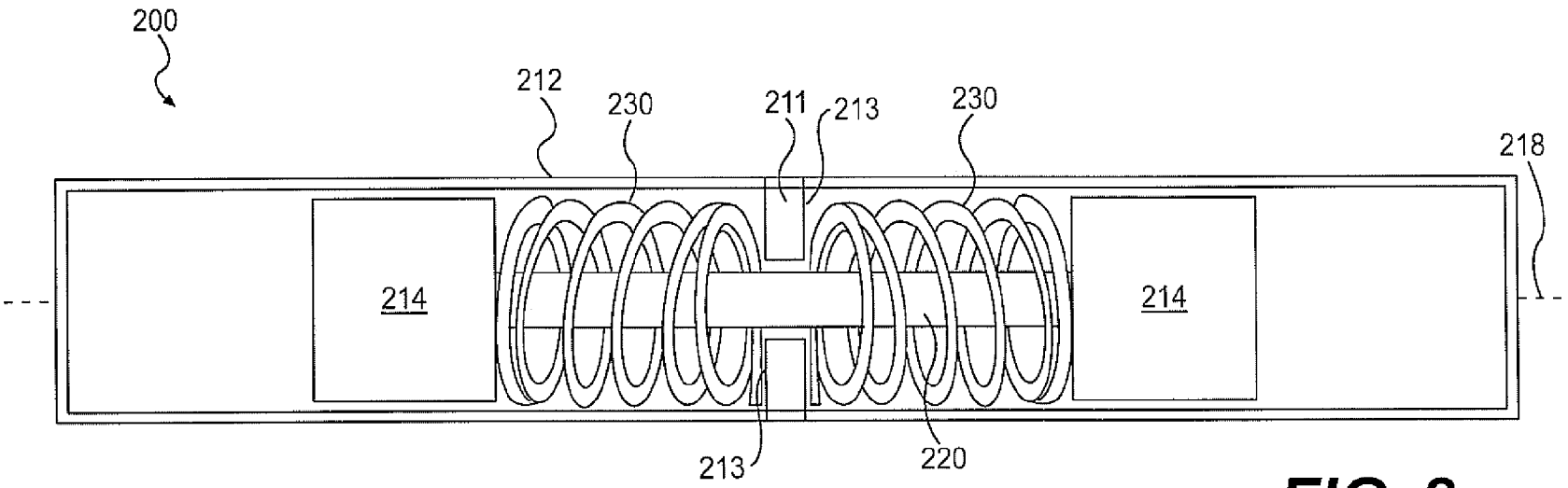
FIG. 8 is a cross-sectional view of another alternative embodiment of an inertial exercise device.
Figure 9:
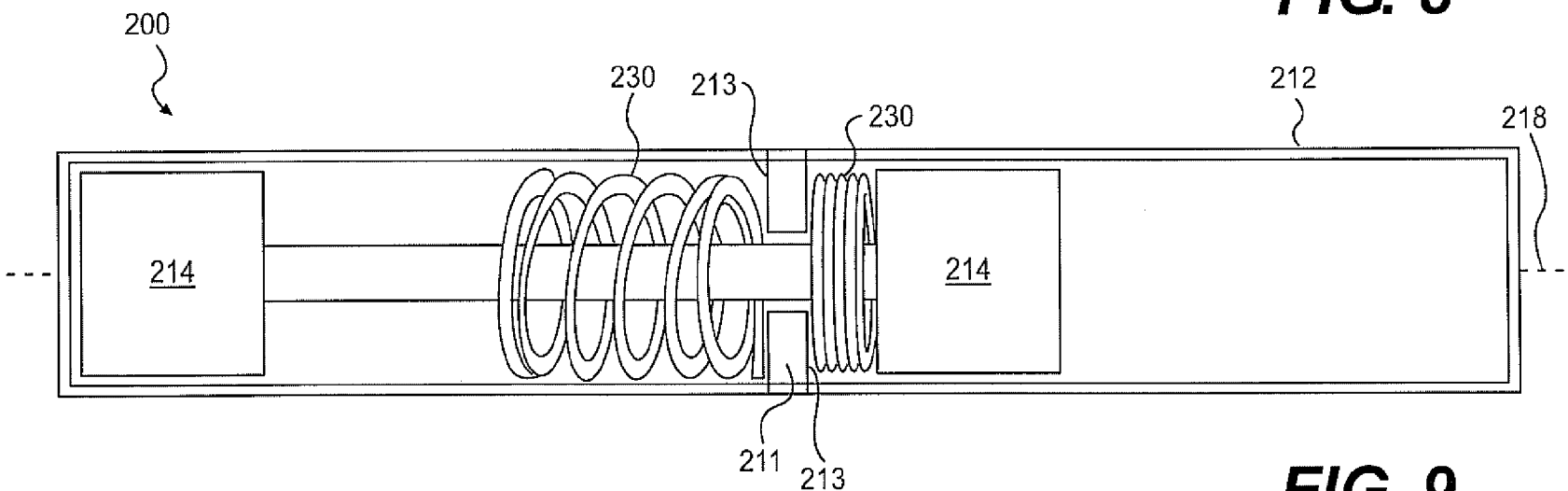
FIG. 9 is a cross-sectional view of the inertial exercise device of FIG. 8 with one of the elastic resistance elements compressed.

It is to be understood that other embodiments of an inertial exercise device are not necessarily in the shape of a traditional dumbbell. For example, as shown in FIGS. 8 and 9, inertial exercise device 200 is in the shape of cylinder. Actuating sleeve or cylinder 212 is a hollow cylinder having at least one central ridge 211 forming first and second peripheral shoulders 213. Central shaft 220 rigidly connects terminal masses 214 to one another. Terminal masses 214 are slidably contained inside actuating sleeve 212 so that terminal masses 214 and central shaft 220 can move in a telescopic motion from side to side inside actuating sleeve 212. This motion is resisted, however, by first and second elastic resistance elements 230, which are mounted on central shaft 220 inside actuating sleeve 212. The inner end of each elastic resistance element is braced against peripheral shoulder 213.

Thus, as the user quickly moves the actuating sleeve in one direction along its longitudinal axis 218, the inertia of terminal masses 214 and central shaft 220 will cause elastic resistance element 230 to be compressed between peripheral shoulder 213 and terminal mass 214. In other words, when the user quickly accelerates actuating sleeve 212 along its longitudinal axis 218, the inertia of terminal masses 214 and central shaft 220 will initially cause them to remain at rest relative to actuating sleeve 212. This relative motion between actuating sleeve 212 and terminal masses 214 causes one of elastic resistance elements 230 to be compressed. As the user oscillates actuating sleeve 212 along its longitudinal axis 218, each elastic resistance element is alternatively compressed in turn. FIG. 8 shows inertial exercise device 200 at rest, and FIG. 9 shows inertial exercise device 200 with one of elastic resistance elements 230 compressed after the user has quickly moved inertial exercise device 200 along its longitudinal axis 218. Although not shown in these figures, the outer surface of actuating sleeve 212 may include grip features such as indents or protrusions that help prevent inertial exercise device 200 from slipping from the user's hand.

It is to be understood that in the embodiment shown in FIGS. 8 and 9, actuating sleeve 212 may be open-ended at one or both ends. If so, terminal masses 214 may protrude partially out of the open ends of actuating sleeve 212 as terminal masses 214 oscillate inside actuating sleeve 212.

Figure 10:
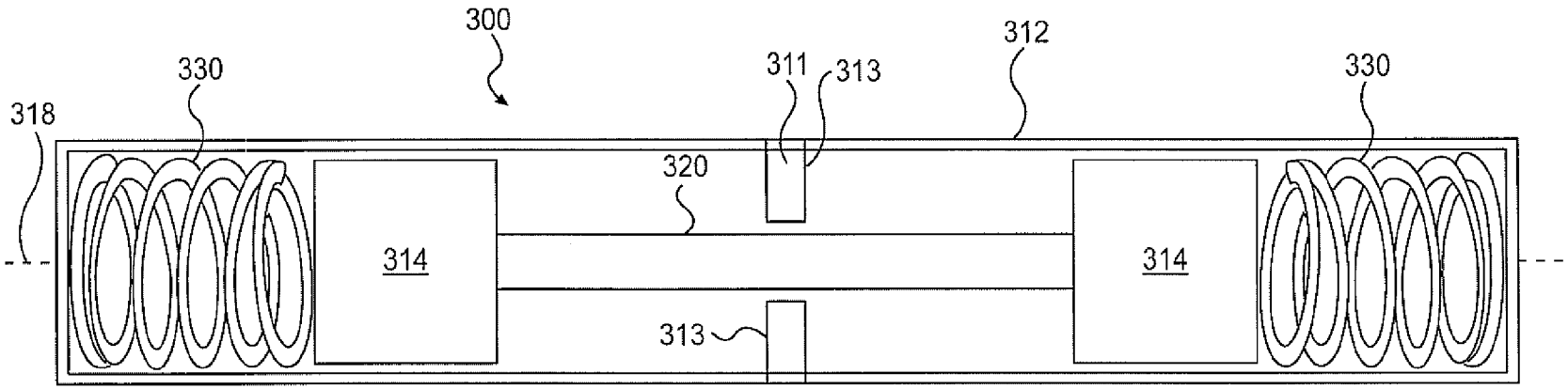
FIG. 10 is a cross-sectional view of yet another alternative embodiment of an inertial exercise device.
Figure 11:
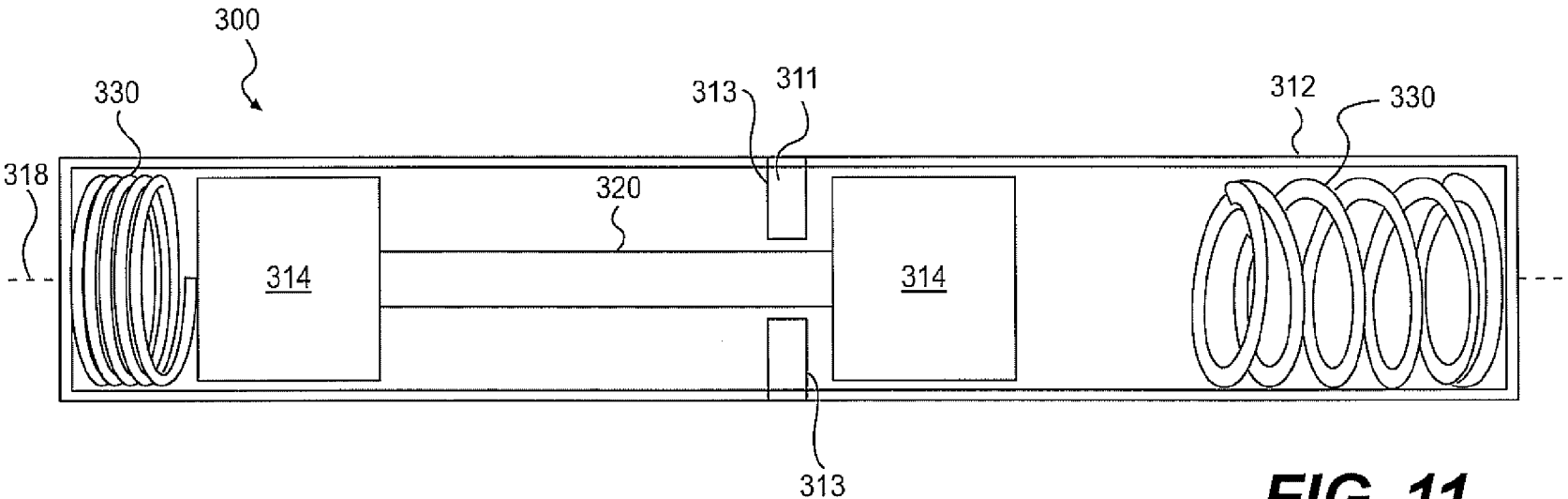
FIG. 11 is a cross-sectional view of the inertial exercise device of FIG. 10 with one of the elastic resistance elements compressed.

Another cylindrical shaped inertial exercise device is shown in FIGS. 10 and 11. Inertial exercise device 300 includes actuating sleeve or cylinder 312, which is again a hollow cylinder that may have a central ridge 311 forming first and second peripheral shoulders 313. However, in this embodiment, central ridge 311 and peripheral shoulders 313 may be completely eliminated because, unlike the previous embodiment, they are not needed for bracing elastic resistance elements 330. Terminal masses 314 are slidably contained inside actuating sleeve 312 so that terminal masses 314 and central shaft 320 can move in a telescopic motion from side to side inside actuating sleeve 312. This motion is resisted, however, by first and second elastic resistance elements 330, which are mounted inside actuating sleeve 312 and disposed between terminal masses 314 and the ends of actuating sleeve 312.

Thus, as the user quickly moves the actuating sleeve in one direction along its longitudinal axis 318, the inertia of terminal masses 314 and central shaft 320 will cause elastic resistance elements 330 to be compressed between the ends of actuating sleeve 312 and the outer faces of terminal masses 314. In other words, when the user quickly accelerates actuating sleeve 312 along its longitudinal axis 318, the inertia of terminal masses 314 and central shaft 320 will initially cause them to remain at rest relative to actuating sleeve 312. This relative motion between actuating sleeve 312 and terminal masses 314 causes one of elastic resistance elements 330 to be compressed. As the user oscillates actuating sleeve 312 along its longitudinal axis 318, each elastic resistance element 330 is alternatively compressed in turn. FIG. 10 shows inertial exercise device 300 at rest, and FIG. 11 shows inertial exercise device 300 with one of elastic resistance elements 330 compressed after the user has quickly moved inertial exercise device 300 along its longitudinal axis 318. Although not shown in the figures, the outer surface of actuating sleeve 312 may include grip features such as indents or protrusions that help prevent inertial exercise device 300 from slipping from the user's hand.

A variation of this embodiment is to use a single inertial element (i.e. mass) rather than two terminal masses rigidly connected to one another. For example, terminal masses 314 and central shaft 320 may completely replaced by a single cylindrical mass or slug slidably disposed in actuating sleeve 312 much like a piston. As the user oscillates actuating sleeve 312 along its longitudinal axis 318, the slug alternately compresses each elastic resistance element 330 between its outer face and the ends of actuating sleeve 312.

Although the embodiments disclosed above are either generally shaped like dumbbells or cylinders, the exact shape of the inertial exercise device is not critical. For example, the cross-section of the actuating sleeve and/or the terminal masses may not even be round, and may be polygonal such as a hexagon. Further, the inertial exercise device may be made in a wide variety of sizes, including small sizes for use with only one hand, or larger sizes for use with both hands. For example, the inertial exercise device may be approximately 12, inches long with a 1.5, inch outer diameter actuating sleeve and 3.5, inch diameter, 1.5, inch thick terminal masses. The total longitudinal travel of the actuating sleeve relative to the central shaft and terminal masses may be approximately 1.75, inches, or about 15% of the total length of the inertial exercise device. These dimensions are just one example of the possible size of an inertial exercise device, and are not to be considered limiting in any way.

The materials used to manufacture the inertial exercise device are likewise not critical. The actuating sleeve may be plastic and the central shaft may be metal, but any materials may be used. The terminal masses generally include a metal inertial mass simply to increase the inertia of the device, but any relatively dense material may be used for the inertial masses. The elastic resistance elements may be metal or elastomeric springs or cushions. The spring constant of the elastic resistance element is not critical but depends on the mass of the terminal masses used. For example, for 2.5, pound terminal masses, the spring constant of the elastic resistance element may be approximately 10, lbs/in.

One of the main advantages of the disclosed inertial exercise devices is that a user can vigorously exercise muscles without using heavy weights. The terminal masses used may be as small as one or two pounds each, but by quickly oscillating the device along its longitudinal axis, the user is constantly battling the inertia of the terminal masses and the resistance of the elastic resistance elements. Further, the inertial exercise device can be used to exercise far more muscles at one time than is possible with a standard dumbbell. For example, a user oscillating the inertial exercise device along its longitudinal axis and substantially parallel to the user's shoulders will exercise muscles in the arms, shoulders, chest and abdomen simultaneously.

EXAMPLE

The benefits of the disclosed inertial exercise devices were demonstrated in a study of a total of 20, subjects (12, males, 8, females). The average age of the subjects was 25.6 years (standard deviation=4.1, years) with a minimum of 21, years and a maximum of 31 years. All subjects were relatively healthy and relatively fit. Most participated in some form of cardiovascular exercise program and/or strength training program.

Subjects were given a visual demonstration of the low-impact inertial exercise device (hereinafter "ShakeWeight" or "SW"). In addition, subjects were provided with approximately 5-10, minutes of practice time using the SW, to assure proper positioning with the device and sufficient comfort with the range of motion of the device. Once comfortable with the SW, subjects were fitted with electromyogram (EMG) electrodes on the following muscle sites: External Oblique (abdominal), Pectoralis Major (chest), Middle Deltoid (shoulder), Biceps Brachii (upper arm, front), Upper Trapezius and Middle Trapezius (shoulder girdle), Thoracic Erector Spinae (back), and Medial Tricep (upper arm, back). The ground electrode was placed on the anterior superior iliac spine. All EMG electrodes were placed on the right side of the body.

Subjects completed 12, different exercise routines, using the SW and a dumbbell as well as performing standard crunch and push-up routines. The routines included the following:

1. SW bicep shake
2. SW bicep full repetition
3. SW tricep shake
4. SW tricep full repetition
5. SW push-pull
6. SW twist side-side
7. Dumbbell bicep curl
8. Dumbbell tricep extension
9. Dumbbell one-arm row (bent over)
10. Dumbbell lateral fly standing
11. Standard floor crunch
12. Standard push-up All dumbbell routines were performed at a uniform pace of a six-second repetition. The pace was maintained by the use of an auditory metronome that provided an audible beep every three seconds. Subjects were instructed to change direction at the sound of the beep and to maintain constant, fluid motion. Subjects completed approximately five repetitions of each of the dumbbell routines and the crunch and push-up routines. A 60-second rest was provided between routines. The SW routines were performed for approximately six seconds for routines #1, 3, 5,, and 6. For routines #2, and #4, (full repetition with SW), subjects completed two full repetitions.

The total area of EMG (which is an estimate of muscle work), based on a single full repetition and based on the summation of all eight muscles, was estimated for each of the twelve exercise routines. The area is based on an established time of six seconds to complete a full repetition for each of the standard exercises. The same time normalization was established for the SW exercises.

All SW routines produced significantly greater work (EMG area) compared with any of the standard exercises (i.e., dumbbell exercises, crunch exercise, push-up routine).

Table 1, provides the average area of EMG for each of the twelve exercise routines. This area is a summation of all muscles tested. For instance, the total area for the Dumbbell Curl (DB curl) was 1209.02, microvolt-seconds (μv·s) and the total area for a single repetition of a ShakeWeight bicep curl (SW bicep curl) was 5004.54, μv·s. The SW resulted in over four times the amount of total muscle work (summing all muscles), compared with the standard dumbbell curl.

TABLE 1

Mean (μv · s) and standard deviation for each of the twelve exercise conditions, summed across all eight muscles.

| Routine | Mean (μv · s) | Std. Deviation | N |
|---|---|---|---|
| DB curl | 1209.0167 | 368.99781 | 17 |
| DB tricep extension | 1214.9500 | 138.68263 | 18 |
| DB lateral fly | 1840.5500 | 187.83938 | 18 |
| DB one-arm row | 964.0500 | 156.60903 | 19 |
| SW bicep fixed | 3302.2430 | 535.94178 | 20 |
| SW tricep fixed | 2982.5200 | 258.56921 | 17 |
| SW side-side twist | 32043825 | 383.55000 | 20 |
| SW push-pull | 2701.9900 | 505.21213 | 16 |
| SW bicep curl | 5004.5400 | 789.64885 | 17 |
| SW tricep extension | 4307.6040 | 602.73946 | 20 |
| Crunch | 440.6333 | 106.18907 | 15 |
| Push-up | 1403.0667 | 429.34959 | 18 |
| Total | 2377.4581 | 322.8090 | 205 |

Regardless of the exercise routine, the SW routines consistently resulted in significantly greater motor unit recruitment (EMG) and work (area) for each muscle, when compared to the standard exercises ($p<0.05$).

Figure 12:
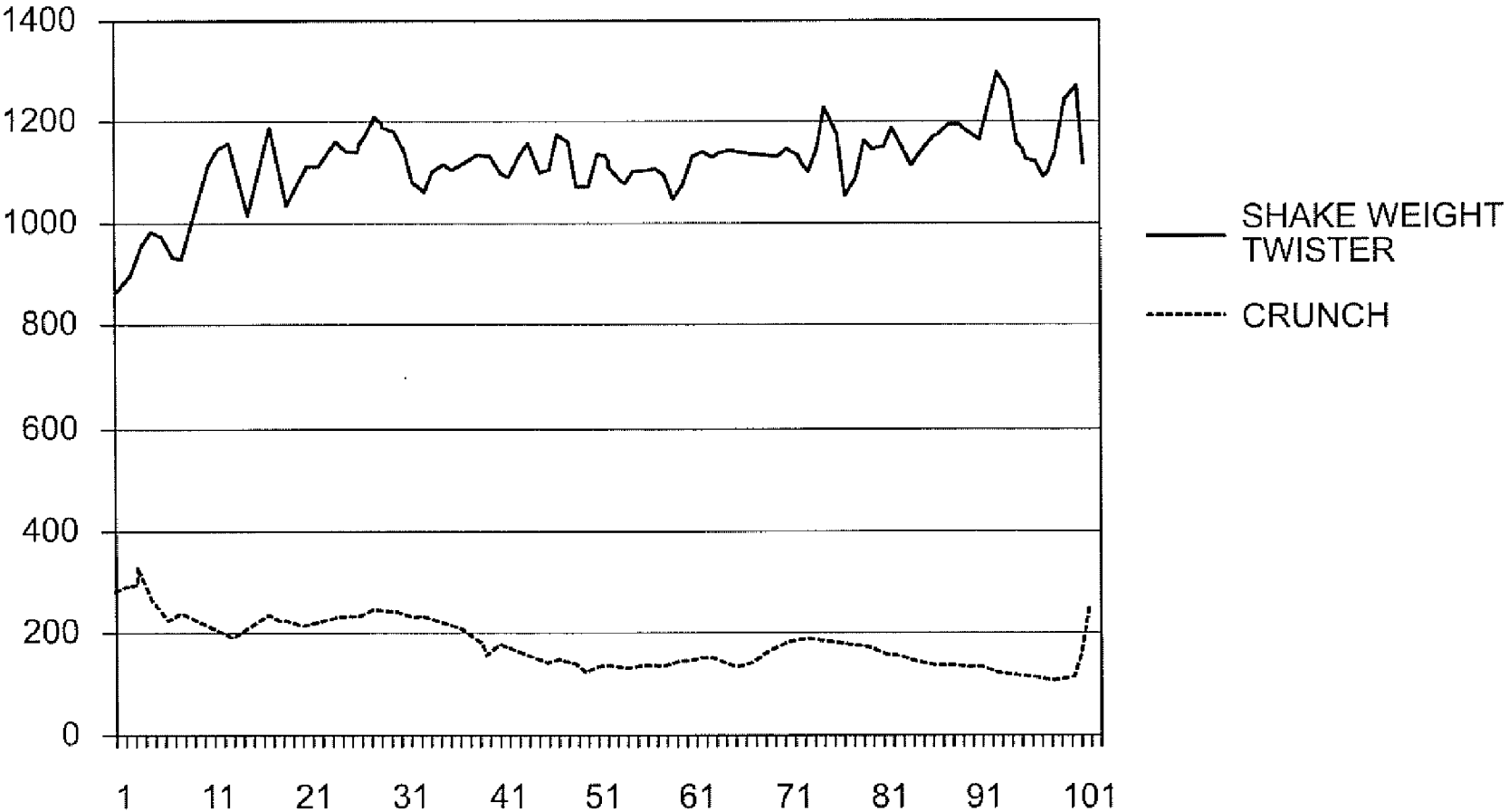
FIG. 12 is a graph showing a comparison of total muscle activity during a side-to-side exercise using an inertial exercise device, and a standard abdominal crunch.

FIG. 12 shows comparison of total muscle activity during a side-to-side exercise using an inertial exercise device, and a standard abdominal crunch. The average EMG reading for all muscles was 1120, μv for the inertial exercise device side-to-side twist, and 178, μv for the abdominal crunch.

Figure 13:
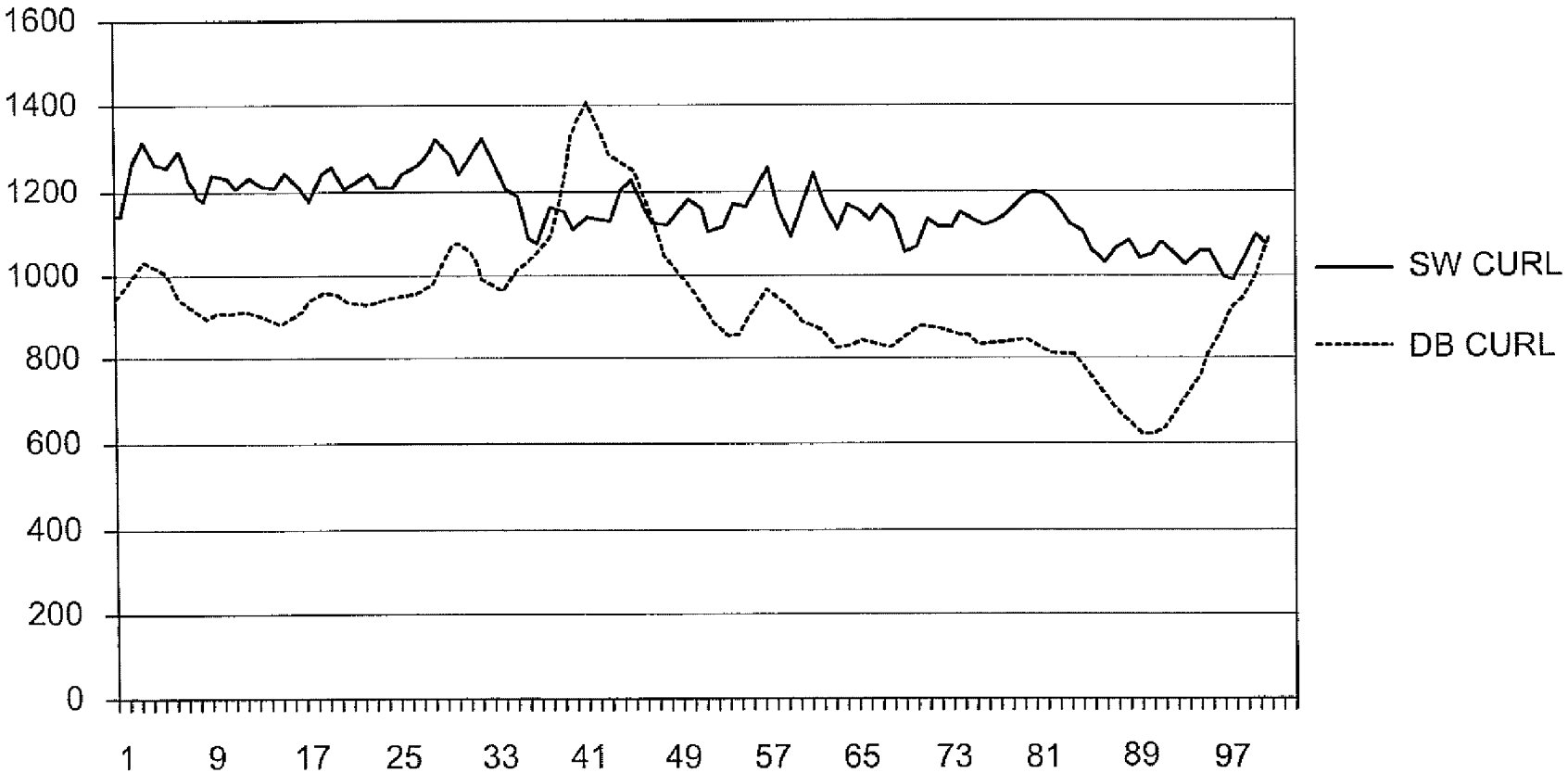
FIG. 13 is a graph showing a comparison of total muscle activity during a bicep curl with an inertial exercise device and with a standard dumbbell.

FIG. 13 shows a comparison of total muscle activity during a bicep curl with an inertial exercise device and with a standard dumbbell. The average EMG reading for all muscles was 1167, μv for the inertial exercise device bicep curl and 933, μv for the standard dumbbell bicep curl.

Figure 14:
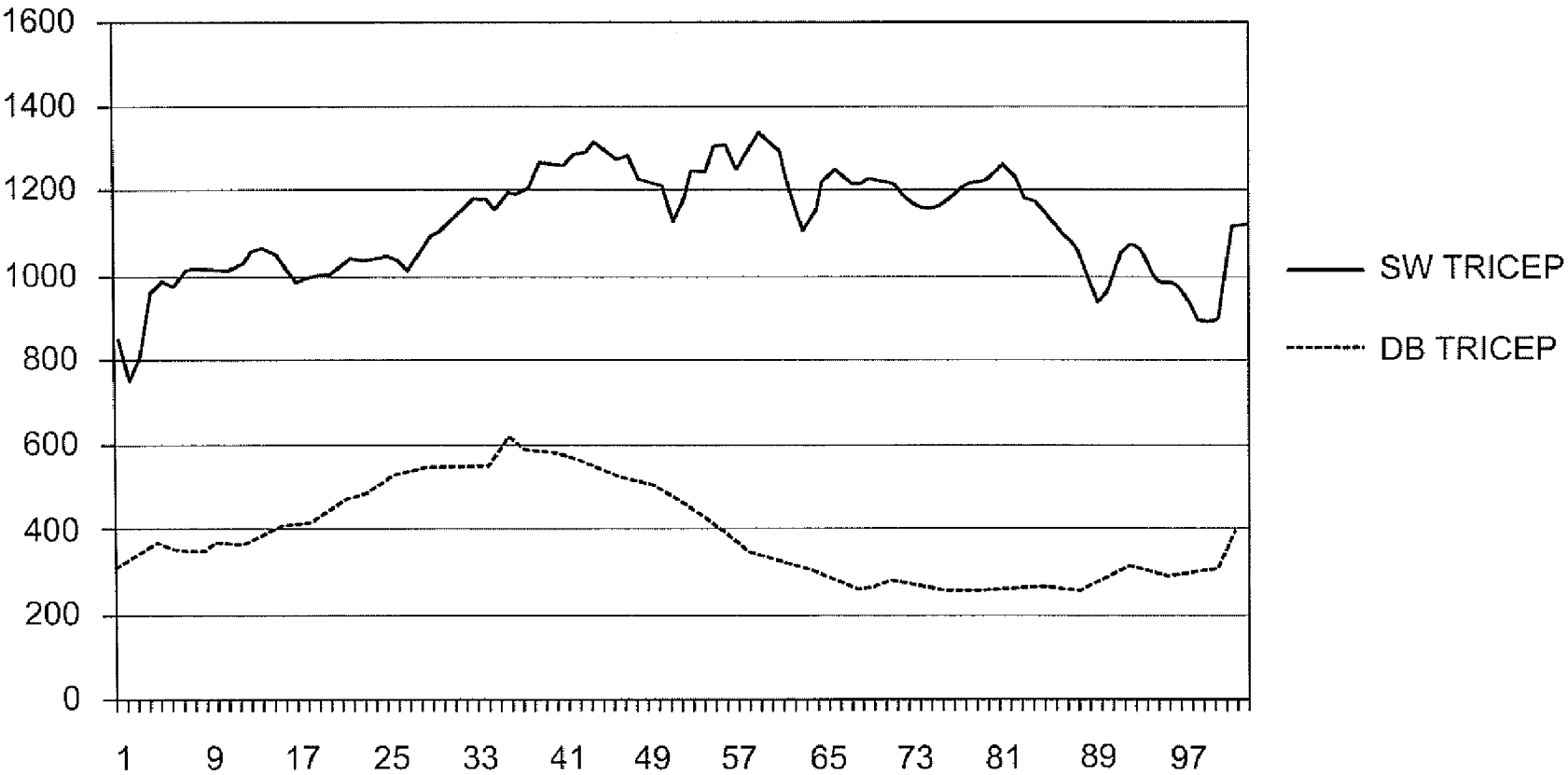
FIG. 14 is a graph showing a comparison of total muscle activity during a triceps repetition using an inertial exercise device, and a standard dumbbell triceps extension.

FIG. 14 shows a comparison of total muscle activity during a triceps repetition using an inertial exercise device, and a standard dumbbell triceps extension. The average EMG reading for all muscles was 1123, μv for the inertial exercise device triceps repetition and 388, μv for the standard dumbbell triceps extension.

It can thus clearly be seen that the inertial exercise device is a significant improvement over these standard dumbbell exercises. Not only are more muscles exercised in each routine, but those muscles also have greater activity.

What has been described above includes examples of one or more embodiments. It is, of course, not possible to describe every conceivable combination of components or methodologies for purposes of describing the aforementioned embodiments, but one of ordinary skill in the art may recognize that many further combinations and permutations of various embodiments are possible. Accordingly, the described embodiments are intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. An inertial exercise device, comprising:

first and second terminal masses rigidly linked together by a central shaft, the first and second terminal masses and the central shaft collectively having an inertia;

an actuating sleeve slidably mounted around the central shaft, the actuating sleeve comprising an internal bore with a first peripheral shoulder;

a first elastic resistance element mounted on the central shaft within the internal bore of the actuating sleeve and disposed between the first terminal mass and the first peripheral shoulder; and wherein the first and second terminal masses and the central shaft are slidable relative to the actuating sleeve between a first position with the first elastic resistance element compressed between the first terminal mass and the first peripheral shoulder and a second position with the first elastic resistance element extended; and wherein the inertia of the first and second terminal masses and the central shaft causes the actuating sleeve to oscillate relative to the first and second terminal masses and the central shaft in response to alternating rhythmic linear motion imparted to the actuating sleeve by a user of the inertial exercise device.

2. The inertial exercise device of claim 1, wherein the internal bore of the actuating sleeve further comprises a second peripheral shoulder, the inertial exercise device further comprising a second elastic resistance element mounted on the central shaft within the internal bore of the actuating sleeve and disposed between the second terminal mass and the second peripheral shoulder, wherein the second elastic resistance element is extended when the first and second terminal masses and the central shaft are in the first position, and wherein the second elastic resistance element is compressed between the second terminal mass and the second peripheral shoulder when the first and second terminal masses and the central shaft are in the second position.

3. The inertial exercise device of claim 1, wherein the first and second terminal masses are disposed within the internal bore of the actuating sleeve.

4. The inertial exercise device of claim 2, wherein the first and second peripheral shoulders are opposing faces of a ridge in the internal bore of the actuating sleeve.

5. An inertial exercise device, comprising:

an actuating cylinder having opposing first and second ends and an internal bore;

at least one mass slidably mounted in the internal bore of the actuating cylinder; and first and second elastic resistance elements mounted within the internal bore of the actuating cylinder and resisting motion of the at least one mass toward the ends of the actuating cylinder;

wherein the at least one mass is slidable relative to the actuating cylinder between a first position with the first elastic resistance element compressed and a second position with the first elastic resistance element extended; and wherein the inertia of the at least one mass causes the at least one mass to oscillate relative to the actuating cylinder in response to alternating rhythmic linear motion imparted to the actuating cylinder by a user of the inertial exercise device.

6. The inertial exercise device of claim 5, further comprising a second mass rigidly connected to the at least one mass by a central shaft.

7. The inertial exercise device of claim 6, wherein the internal bore of the actuating cylinder comprises first and second peripheral shoulders, wherein the first elastic resistance element is disposed between the first peripheral shoulder and the at least one mass, and wherein the second elastic resistance element is disposed between the second peripheral shoulder and the second mass.

8. The inertial exercise device of claim 5, wherein the at least one mass has first and second opposing faces, and wherein the first elastic resistance element is disposed between the first face of the at least one mass and the first end of the actuating cylinder, and the second elastic resistance element is disposed between the second face of the at least one mass and the second end of the actuating cylinder.

* * * * *